US010900740B1

(12) United States Patent
Casto, Jr.

(10) Patent No.: US 10,900,740 B1
(45) Date of Patent: Jan. 26, 2021

(54) MODULAR MULTI-PROJECTILE PNEUMATIC LAUNCHER

(71) Applicant: Arlos Franklin Casto, Jr., Marietta, OH (US)

(72) Inventor: Arlos Franklin Casto, Jr., Marietta, OH (US)

( * ) Notice: Subject to any disclaimer, the term of this patent is extended or adjusted under 35 U.S.C. 154(b) by 0 days.

(21) Appl. No.: 16/776,097

(22) Filed: Jan. 29, 2020

Related U.S. Application Data

(63) Continuation-in-part of application No. 29/713,717, filed on Nov. 18, 2019.

(60) Provisional application No. 62/908,395, filed on Sep. 30, 2019.

(51) Int. Cl.
*F41B 11/723* (2013.01)
*F41B 11/62* (2013.01)

(52) U.S. Cl.
CPC ..... *F41B 11/723* (2013.01); *F41B 11/62* (2013.01)

(58) Field of Classification Search
CPC ..... F41B 11/70; F41B 11/71; F41B 11/72; F41B 11/721; F41B 11/723; F41B 11/89; F41B 11/62
USPC ..... 124/57, 58, 71–77
See application file for complete search history.

(56) References Cited

U.S. PATENT DOCUMENTS

| | | | | |
|---|---|---|---|---|
| 3,315,564 | A * | 4/1967 | Hazlett, Jr. | B64D 1/06 89/1.51 |
| 6,276,353 | B1 | 8/2001 | Briggs et al. | |
| 8,087,406 | B2 | 1/2012 | Axelsson | |
| 8,146,193 | B1 | 4/2012 | Franzino et al. | |
| 9,752,846 | B1 | 9/2017 | Kenaley et al. | |
| 2006/0011183 | A1* | 1/2006 | Dziob | F16K 24/04 124/71 |
| 2009/0145414 | A1 | 6/2009 | Russell et al. | |
| 2014/0116533 | A1* | 5/2014 | Edler | F16L 37/42 137/315.01 |
| 2014/0331984 | A1* | 11/2014 | Brahler, II | F41H 13/0006 124/76 |
| 2017/0211906 | A1* | 7/2017 | Colby | F41B 11/724 |

* cited by examiner

*Primary Examiner* — Bret Hayes

(57) ABSTRACT

A pneumatic launcher has a pressure transfer system, a pressure regulation device, a first coupler and a second coupler. The pressure transfer system has a body, a transfer channel and a valve. The transfer channel traverses through the body. The valve is integrated into the transfer channel. The pressure regulation device is connected to a first end of the transfer channel. The first coupler is connected to the pressure regulation device opposite to the first end of the transfer channel. The second coupler is connected to a second end of the transfer channel, opposite to the pressure regulation device. The first coupler is in fluid communication with the second coupler through the pressure regulation device, the transfer channel and the valve.

14 Claims, 10 Drawing Sheets

MODULAR MULTI-PROJECTILE PNEUMATIC LAUNCHER

The current application claims a priority to the U.S. Provisional Patent application Ser. No. 62/908,395 filed on Sep. 30, 2019.

FIELD OF THE INVENTION

The present invention relates generally to a pneumatic launcher. More particularly, the present invention relates to a multi-projectile pneumatic launcher with a pressure regulation device and interchangeable components (barrels, cylinders etc.) for launching commonly launched projectiles.

BACKGROUND OF THE INVENTION

A pneumatic launcher or air cannon is a device that uses compressed air to launch something. While several launchers exist that can launch ball, rocket, ice slug, confetti, or any multitude of known and unknown projectiles, all existing designs are specific to certain object/size/projectile, and thus have limited usefulness. For a launcher to be effective and useful, the right amount of pneumatic energy has to be released from an efficient source. While successful launchers exist, they use fixed chamber volumes and/or pressure ranges that cannot be changed, as they are not replaceable or interchangeable by design. This limit the type of projectile to only those that perform effectively with the existing fixed, chamber volume and barrel size. Further, using increased pressure, rather than increased volume, often leads to higher launch pressures, which can damage many soft or brittle projectiles. Current launcher devices in the market that use CO2 (carbon dioxide) as the source, operate at higher pressures, in the 300-900 PSI (pounds per square inch) range and therefore cannot use air that is readily available in the consumer range of 20-150 PSI. On the other end of the spectrum, current launcher devices that are designed for readily available consumer range of 20-150 PSI cannot use CO2 from paintball cylinders and the like, due to the inefficiency of the higher chamber volume and lack of a means to accept a high pressure air system. An objective of the present invention is to provide users with a unique design for a pneumatic launcher that may be used for launching a wide variety of projectiles. According to the present invention, the pneumatic launcher comprises a pressure regulation device, and the option to interchange barrels, chambers, and sources of gasses, thereby enabling a user to create a successful launch of commonly thrown or pneumatically launched projectiles. According to the present invention, different hard, soft, porous, semi porous projectiles, including but not limited to wood, cloth, rubber, leather, ice, and various food items, may be successfully launched without damage. For that, various combinations of the described parts are chosen to launch a desired projectile. The multiple sizes of barrels, chambers, valve configurations and the pressure regulation device, allow the present invention to launch a multitude of projectiles, only limited by what can be handheld, and safe for the operator to launch. The present invention further incorporates an optional and/or removable grip/pneumatic trigger assembly. Thus, the present invention overcomes many of the limitation of existing launchers and can be a replacement for, or be an addition to several types of launchers, including but not limited to sporting, recreational, or industrial uses.

DETAIL DESCRIPTIONS OF THE INVENTION

All illustrations of the drawings are for the purpose of describing selected versions of the present invention and are not intended to limit the scope of the present invention.

In reference to FIG. 1 through FIG. 10, the present invention is a multi-projectile pneumatic launcher. An objective of the multi-projectile pneumatic launcher is to provide users with a unique design for a modular pneumatic launcher that may be used for launching a wide variety of projectiles. According to the present invention, the pneumatic launcher comprises a pressure regulation device, and the option to interchange barrels, chambers, and sources of gasses, thereby enabling a user to create a successful launch of commonly thrown or pneumatically launched projectiles. According to the multi-projectile pneumatic launcher, different hard, soft, porous, semi porous projectiles, including but not limited to wood, cloth, rubber, leather, ice, and various food items, may be successfully launched without damage. For that, various combinations of the described parts are chosen to launch a desired projectile. The multiple sizes of barrels, chambers, valve configurations and the pressure regulation device, allow the present invention to launch a multitude of projectiles, only limited by what can be handheld, and safe for the operator to launch. The multi-projectile pneumatic launcher further incorporates an optional and/or removable grip/pneumatic trigger assembly. Thus, the multi-projectile pneumatic launcher overcomes many of the limitation of existing launchers and can be a replacement for, or be an addition to several types of launchers, including but not limited to sporting, recreational, or industrial uses.

Figure 1:
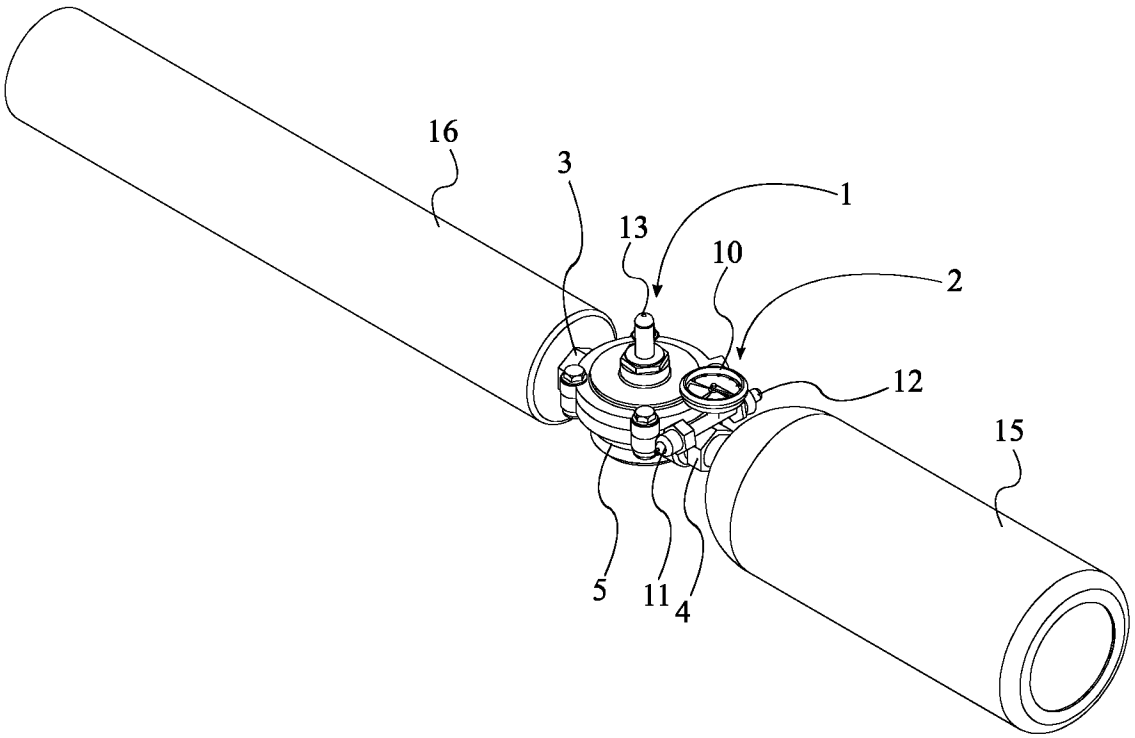
FIG. 1 top-front-left perspective view of the present invention.
Figure 2:
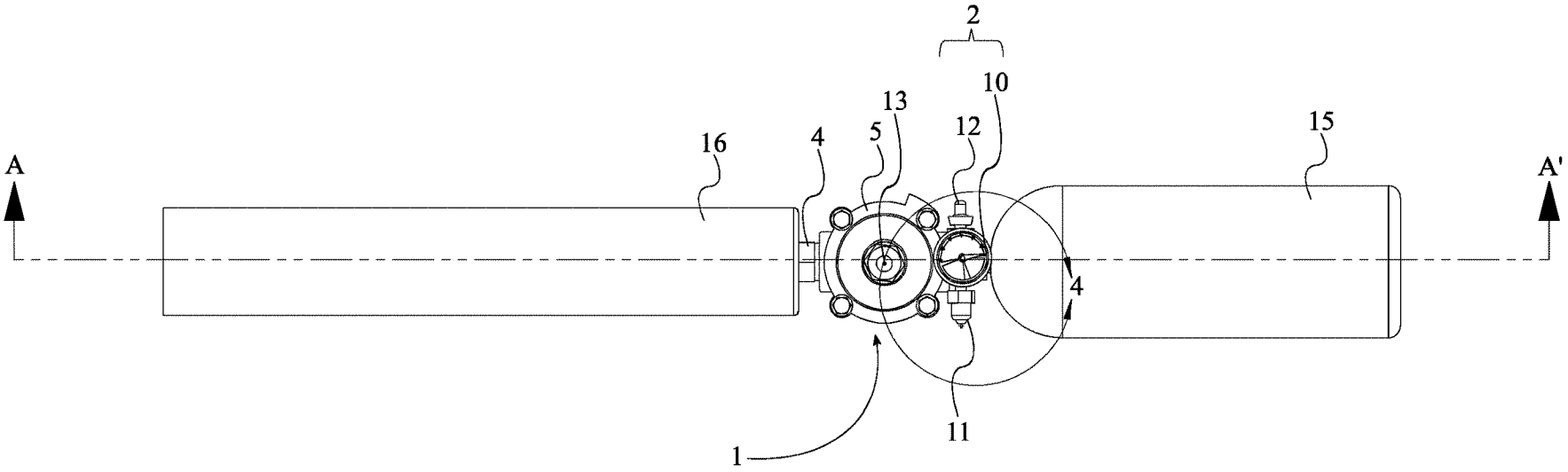
FIG. 2 is a top plan view of the present invention.
Figure 3:
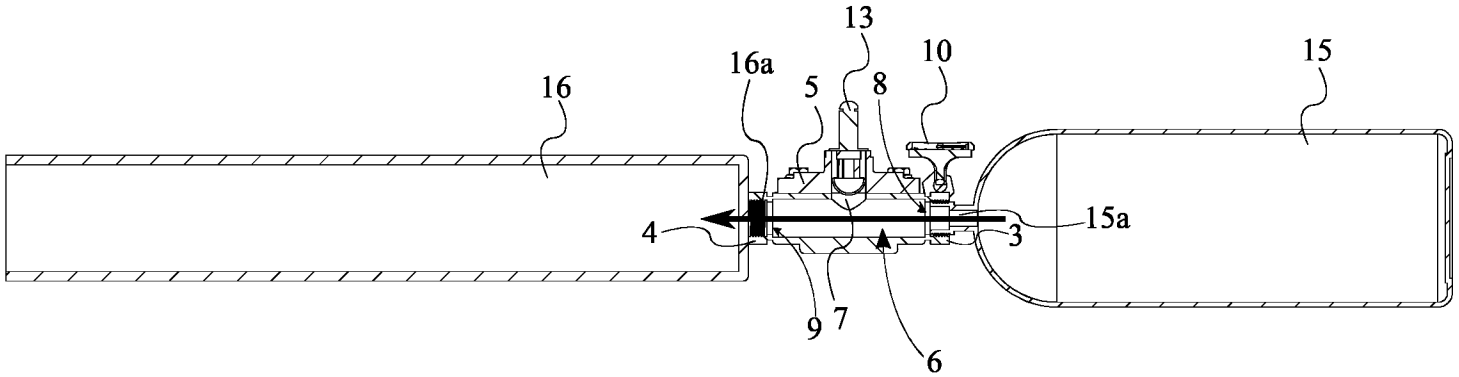
FIG. 3 is a sectional view taken along A-A' of FIG. 2.

The following description is in reference to FIG. 1 through FIG. 10. As seen in FIG. 1, the multi-projectile pneumatic launcher comprises a pressure transfer system 1, a pressure regulation device 2, a first universal coupler 3, and a second universal coupler 4. According to the present invention, the pressure transfer system 1 enables efficient passage of compressed air for performing successful launches. Accordingly, the pressure transfer system 1 of the multi-projectile pneumatic launcher comprises a body 5, a transfer channel 6, and a valve 7. As seen in FIG. 3, the transfer channel 6 traverses through the body 5 and the valve 7 is integrated into the transfer channel 6, such that, operational position of the valve 7 controls the passage of any fluid through the transfer channel 6. According to the multi-projectile pneumatic launcher, the body 5 comprises a non-pliable material, such as a metal. However, any other shatterproof material that is known to one of ordinary skill in the art may be employed, as long as the intended purpose of the present invention is not hindered. Further, the valve 7 is a custom air discharge valve or a diaphragm valve with only one moving part that seal the air valve. Other features of the diaphragm valve or the valve 7 include, but are not limited to, formed of a metal (preferably Aluminum), works with any compressed air/gasses, has a long lifespan (around one million cycles), and is shatterproof. All the above-mentioned features of the valve 7 make the multi-projectile pneumatic launcher a low maintenance, durable and light weight apparatus. According to a preferred embodiment of the present invention, the pressure regulation device 2 is connected to a first end 8 of the transfer channel 6. As seen in FIG. 3, the location of the pressure regulation device 2 enables controlling of the pressure of the fluid, before it enters the transfer channel 6 for effective launching of any projectile. It is an aim of the present invention to be able to launch a wide variety of projectiles. Accordingly, the first universal coupler 3 acts as the connecting portal between the pressure transfer system 1 and multiple interchangeable pneumatic sources that act as fuel for successful projectile launching. Further, the second universal coupler 4 acts as the connecting portal between the pressure transfer system 1 and multiple interchangeable projectile holders. Continuing with the preferred embodiment of the present invention, the first universal coupler 3 is connected to the pressure regulation device 2 opposite to the first end 8 of the transfer channel 6, and the second universal coupler 4 is connected to a second end 9 of the transfer channel 6, opposite to the pressure regulation device 2. Further, the first universal coupler 3 is in fluid communication with the second universal coupler 4 through the pressure regulation device 2, the transfer channel 6, and the valve 7. This fluid communication and positioning of the components ensure that, pressure of the compressed fluid gets regulated as it traverses from the first universal coupler 3 to the second universal coupler 4 through the transfer channel 6

Figure 4:
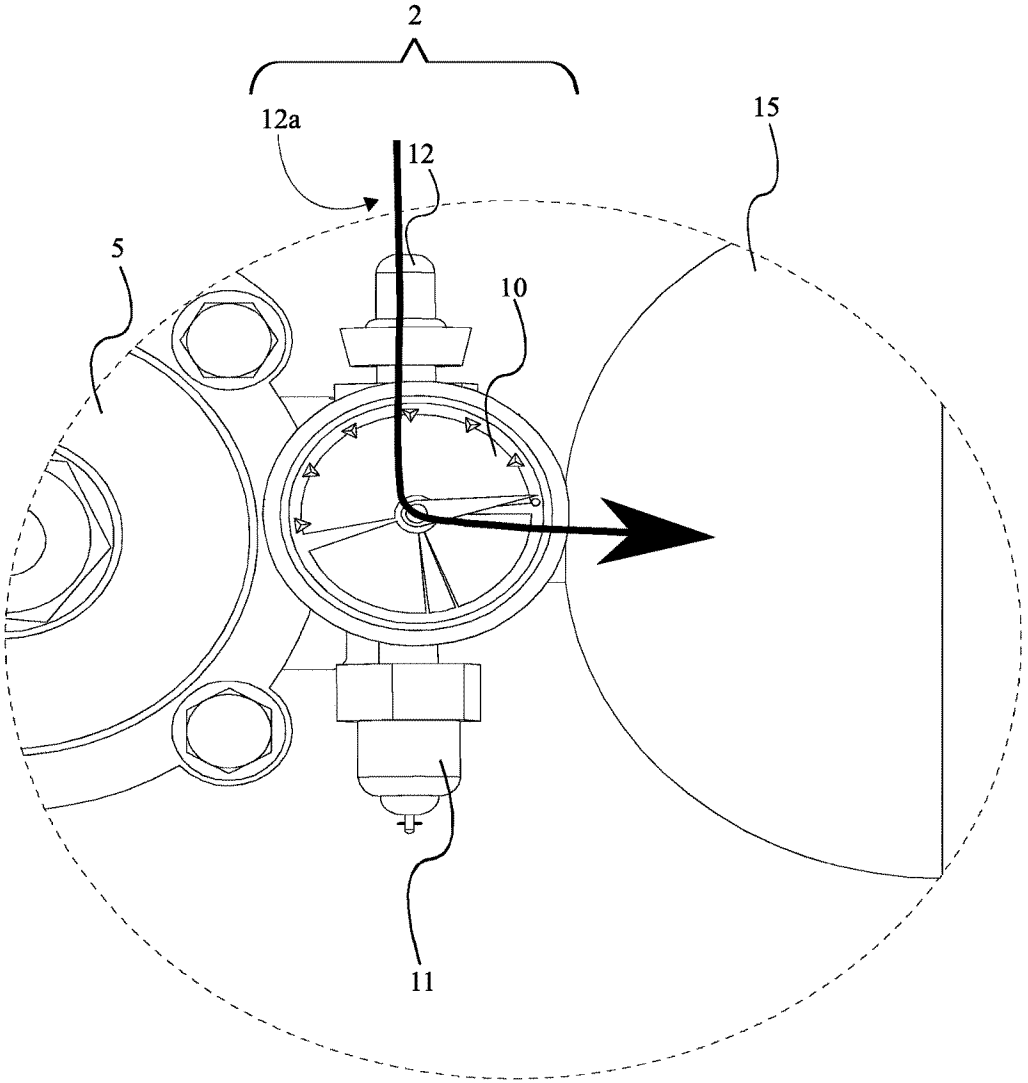
FIG. 4 is a detailed view of section 4 of FIG. 2.

As seen in FIG. 2 and FIG. 4, the pressure regulation device 2 comprises a gauge 10, a user control device 11, and a fill manifold 12. According to the preferred embodiment, the user control device 11 is operatively coupled to the gauge 10 and the first universal coupler 3, such that a user may observe the pressure of the fluid on the gauge 10 and operate the user control device 11 to regulate the pressure of the fluid within the transfer channel 6. Preferably, the gauge 10 is a liquid filled, stainless steel, shock and vibration proof gauge that is positioned between the fill manifold 12 and the user control device 11. Further, the user control device 11 comprises a rotatable cylindrical sleeve that controls a pressure release valve. However, any other kind of pressure gauge and/or pressure control devices that are known to one or ordinary skill in the art may be used. According to the preferred embodiment, the fill manifold 12 is operatively coupled to the first universal coupler 3, wherein the fill manifold 12 is in one-way fluid communication 12*a* with the first universal coupler 3. In other words, as seen in FIG. 4, the fill manifold 12 is an inlet (inward one-way fluid communication 12*a*) for the various interchangeable sources of pressurized fluid that may be used for launching projectiles. The pressurized fluid that comes in through the fill manifold 12, later passes through the transfer channel 6 after pressure regulation (if needed) by the user control device 11.

According to the preferred embodiment, the multi-projectile pneumatic launcher further comprises a trigger 13. Preferably, the trigger 13 is connected adjacent to the body 5 and the trigger 13 is operatively coupled to the valve 7, wherein actuating the trigger 13 governs the operation of the valve 7. In other words, actuating the trigger 13 opens or closes the valve 7, such that the compressed fluid is either passed or blocked across the transfer channel 6 (FIG. 3 shows and the valve 7 as open). According to the present invention, the trigger 13 is a push button pneumatic trigger. However, the trigger 13 may be converted to an electric trigger or any other trigger mechanism that is known to one of ordinary skill in the art. Further, the trigger 13 may be triggered manually, by a solenoid, by a vent button, or other smaller, solenoid or air operated valves. As seen in FIG. 1 through FIG. 3, FIG. 5, and FIG. 8, the trigger 13 is located at the center of the body 5, pointing upward. Furthermore, the trigger 13 may also comprise a safety cover, for preventing accidents. The safety cover may be a pop-off/on sleeve that may be placed covering the trigger, such that actuation of the trigger does not happen accidentally. It should be noted that any other safety attachments that are known to one of ordinary skill in the art, and that does not hinder the intended purpose of the present invention, falls under the scope of the present invention.

Figure 9:
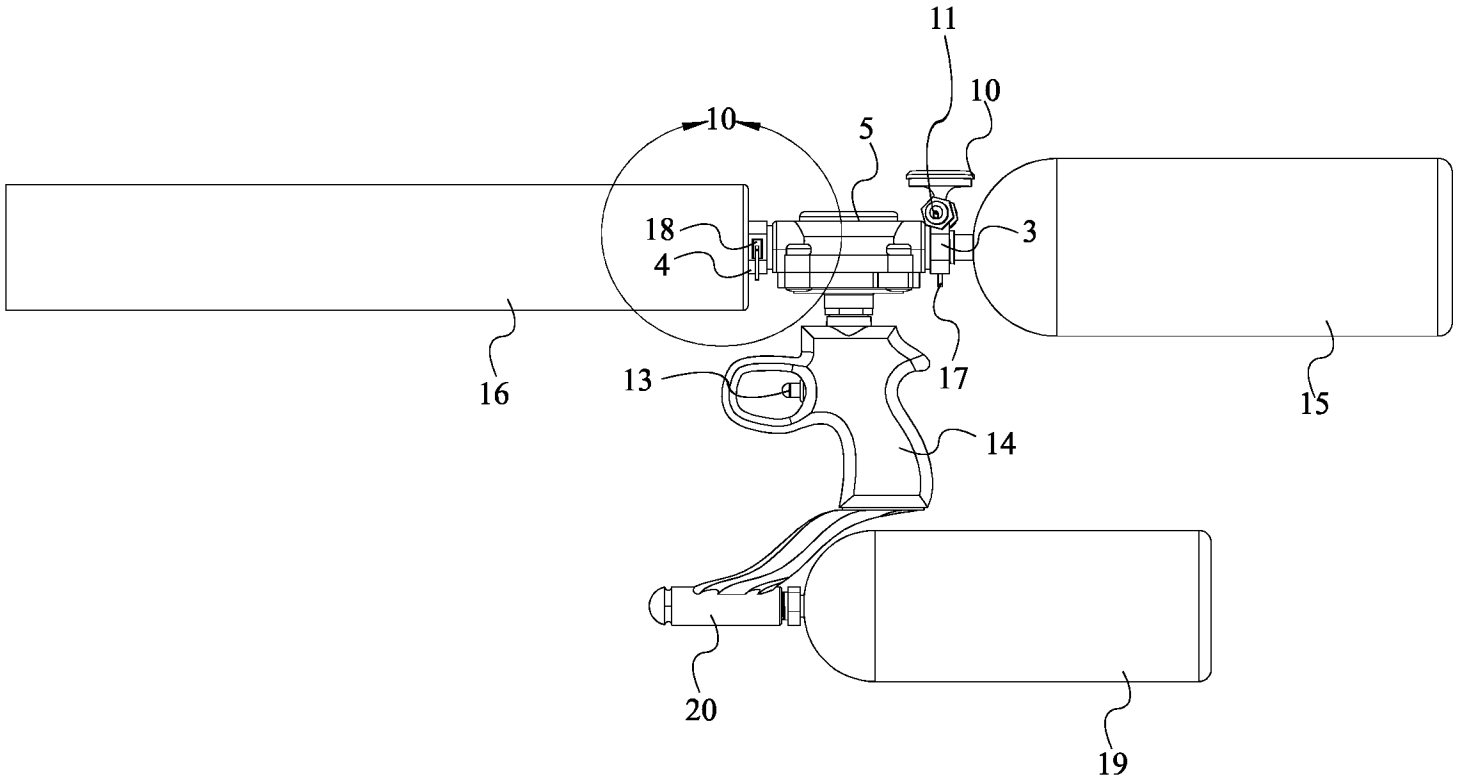
FIG. 9 is a left side perspective view of an alternate configuration of the present invention.

Continuing with the present invention, the multi-projectile pneumatic launcher may be used on a stand or be handheld with any compatible grips. In the preferred embodiment, the present invention comprises a no grip configuration. However, as seen in FIG. 9, in an alternate configuration of the present invention, the grip is pistol like or the multi-projectile launcher comprises a pistol grip 14. It should be noted that, any other grips that are known to one of ordinary skill in the art, falls under the scope of the present invention, as long as the intended purpose of the present invention is not altered. As seen in FIG. 9, in the alternate configuration, the trigger 13 is integrated into the pistol grip 14.

As seen in FIG. 1 through FIG. 10, the multi-projectile pneumatic launcher comprises a cylinder 15 and a cylinder coupler 15*a*, wherein the cylinder coupler 15*a* is terminally connected to the cylinder 15, and wherein the cylinder coupler 15*a* is engaged into the first universal coupler 3. It is an aim of the present invention for users to use any source of compressed gas as the fuel source suited for launching a particular projectile. Preferably, the cylinder 15 comprises a shatterproof, lightweight, metal chamber that is intended to hold compressed air/gasses, thereby providing the fuel for the launch. Such materials for the cylinder 15 include, aluminum, steel, stainless steel, brass or a combination thereof. Further, according to the present invention, the cylinder 15 is interchangeable, and hence different sizes of removable, replaceable and shatterproof metal chambers made in a size suited for holding pressurized fluid for a particular launch may be used and engaged with the first universal coupler 3. In the preferred embodiment, a certified, ultralight, stainless steel, polished cylinder 15 is used. Furthermore, the cylinder 5 is a mid-volume chamber whose volume is matched to an efficient air valve, allowing it to use lower pressures, from 20 PSI to 150 PSI. This mid volume of the cylinder 15, is low enough to also allow use with common CO2 cylinders, such as the ones used in paintball, or with other high-pressure launchers. Accordingly, the interchangeability of the cylinder 15, as well as the presence of the pressure regulation device 2, enables the multi-projectile pneumatic launcher to operate with any pressurized fluid sources, such as sources at high pressure, (over 1,800 PSI,) medium high pressures, (300-900 PSI), or low pressure (40-150 PSI). Accordingly, in alternate configurations, the present invention may comprise air source(s) affixed to the barrel(s), to stand alone and attached by a hose, to stand alone and use temporary means to pressurize, or be configured with the air source(s) attached to the grip.

Continuing with the preferred embodiment of the present invention, the multi-projectile pneumatic launcher comprises a barrel 16, and a barrel coupler 16*a*. Accordingly, the barrel coupler 16 is terminally connected to the barrel 16, and the barrel coupler 16*a* is engaged into the second universal coupler 4. It is an aim of the present invention to provide users with a modular pneumatic launcher that can launch a wide variety of projectiles. Accordingly, the barrel 16 is removable, interchangeable, replaceable, and made from shatter resistant plastics or shatterproof metals. Such materials comprise aluminum, steel, stainless steel, brass or a combination thereof, impact resistant PVC, polycarbonate etc. Further, the barrel 16 can comprise different diameters and lengths, the diameter preferably ranging between less than 1", up to, and including 4" in diameter. The second universal coupler 4 and the barrel coupler 16*a*, engage themselves to form a strong connection between the pressure transfer system 1 and the barrel 16. Preferably, the barrel coupler 16*a*, is connected to the second universal coupler 4 through threaded screws, nuts and bolts. However, any other fasteners that are known to one of ordinary skill in the art may be utilized for fastening the barrel 16 to the pressure transfer system 1.

Figure 5:
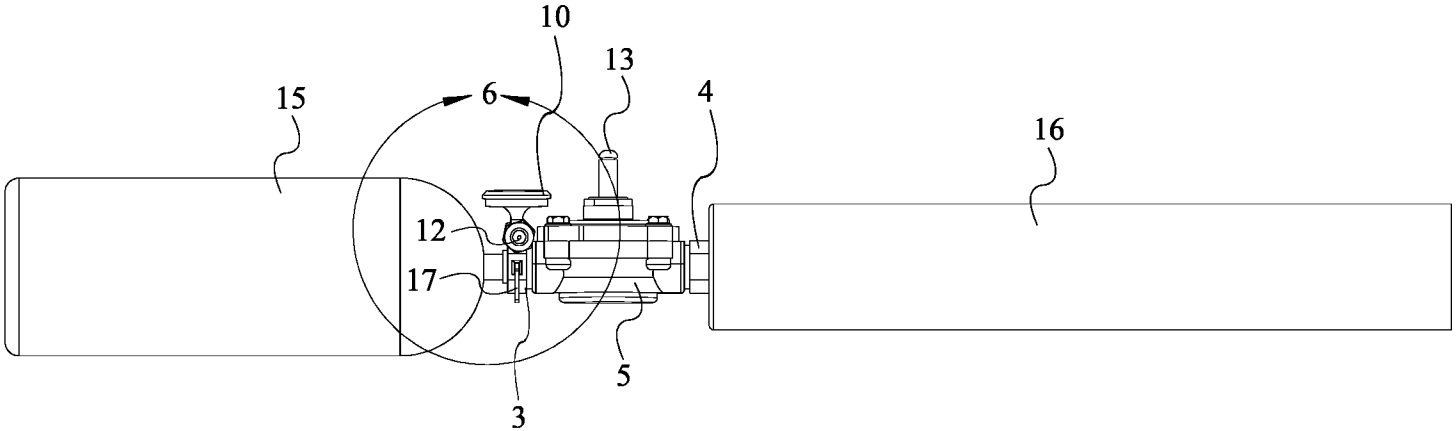
FIG. 5 is a right-side perspective view of the present invention.
Figure 6:
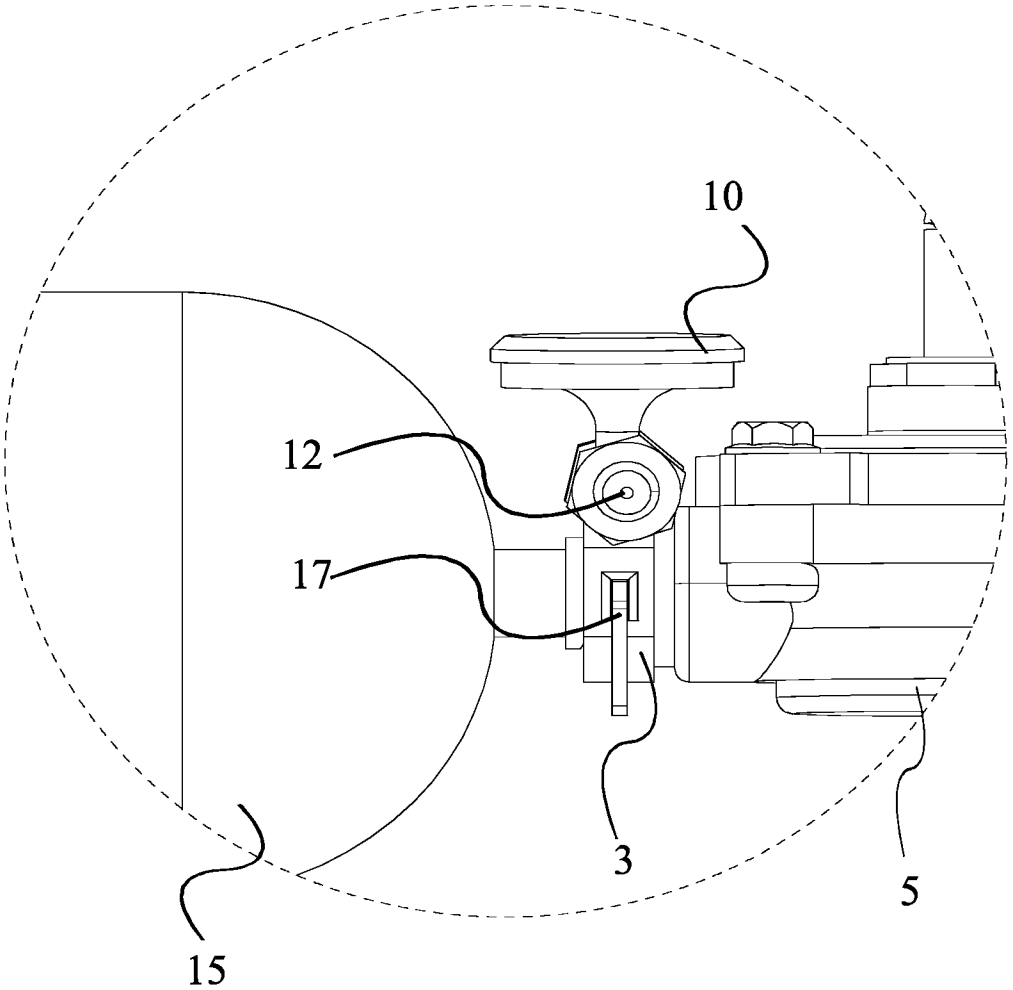
FIG. 6 is a detailed view of section 6 of FIG. 5.
Figure 7:
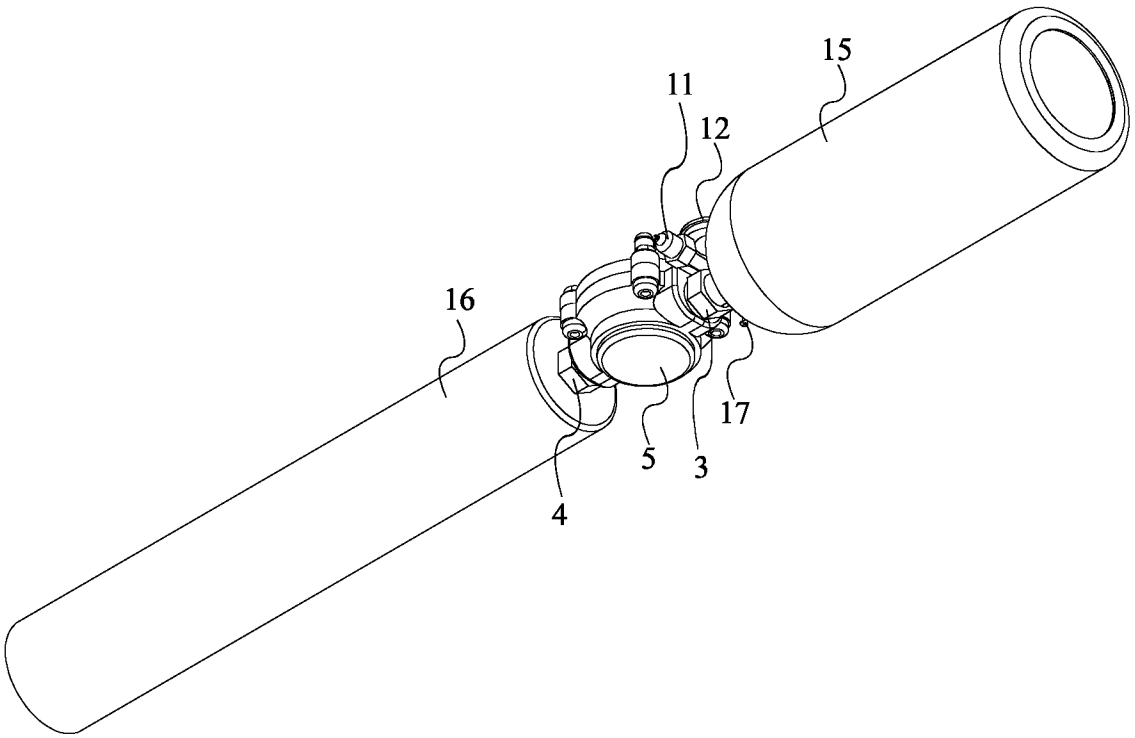
FIG. 7 is a bottom rear left perspective view of the present invention.
Figure 8:
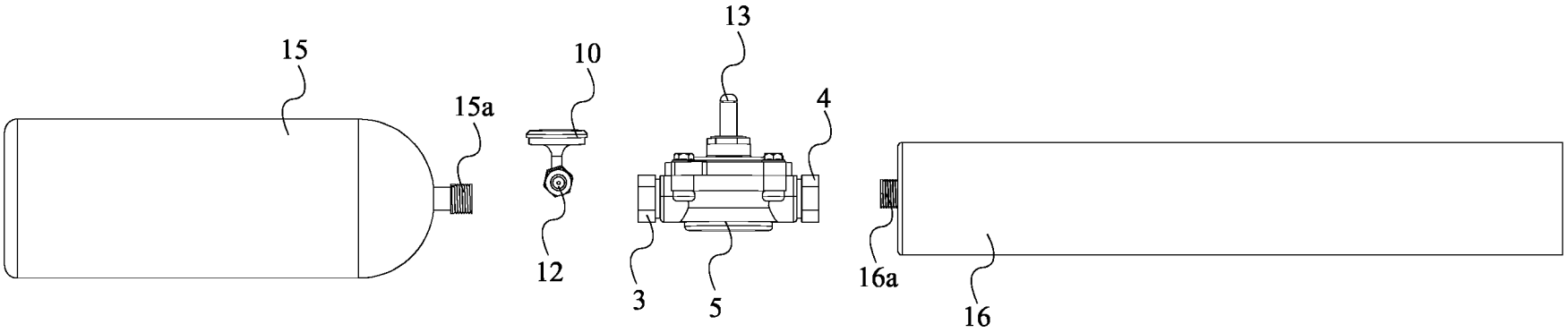
FIG. 8 is a horizontally exploded view of FIG. 5.
Figure 10:
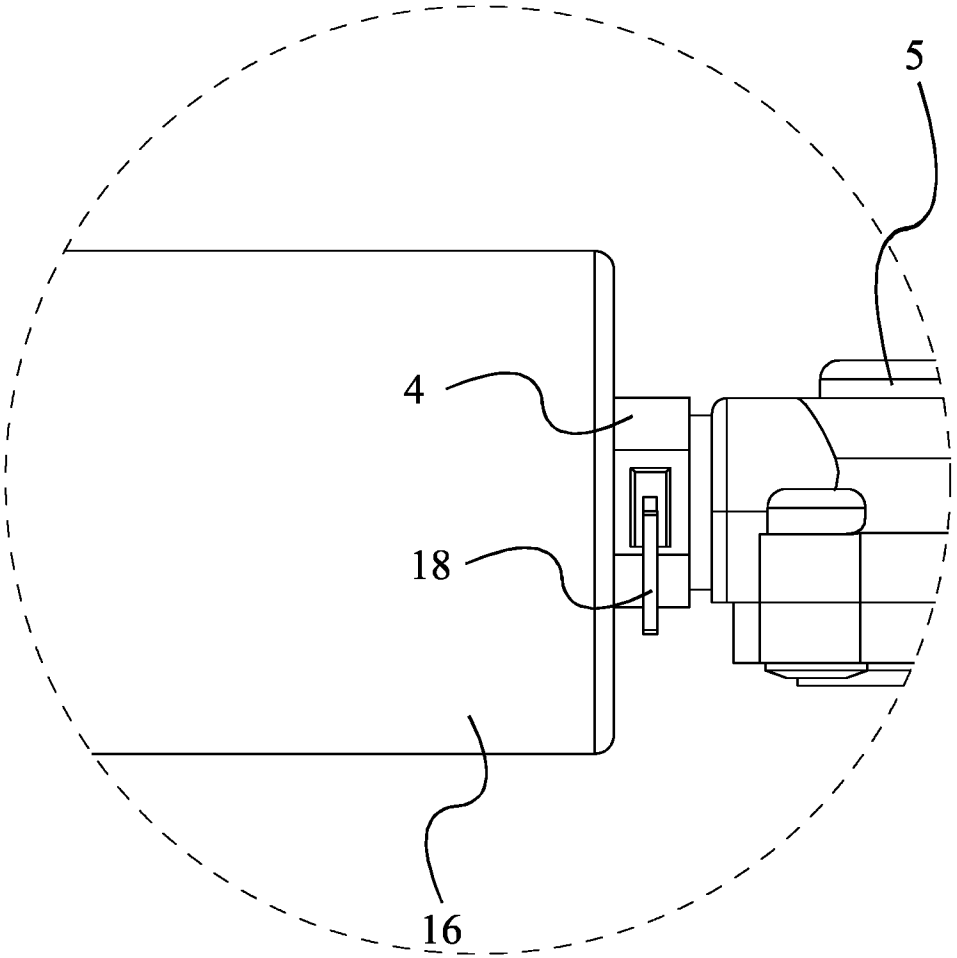
FIG. 10 is a detailed view of section 10 of FIG. 9.

Further, as seen in FIG. 5 and FIG. 6, the multi-projectile pneumatic comprises a first lock 17, wherein the first lock 17 is integrated into the first universal coupler 3. Similarly, as seen in FIG. 9, and FIG. 10, the multi-projectile pneumatic launcher comprises a second lock 18, wherein the second lock 18 is integrated into the second universal coupler 4. The first lock 17 and the second lock 18 are locking systems for additionally securing the cylinder 15 and the barrel 16 respectively to the pressure transfer system 1. As seen in FIG. 5, FIG. 6, FIG. 9 and FIG. 10, the first lock 17 and second lock 18 comprise a simple camlock with a cam handle. However, any other locking mechanisms or additional fasteners that are known to one of ordinary skill in the art may be utilized, as long as the intended purpose of the present invention is not hindered.

As seen in FIG. 9, in the alternate configuration, the multi-projectile purpose pneumatic launcher may comprise an additional cylinder 19 (external/additional air/gas source), such as a CO2 cylinder or other small cylinders of HPA (high pressure compressed air) attached to the pistol grip 14 through a cradle 20. This additional cylinder 19 may even be removably attached to the barrel 16, wherein the barrel has the cradle 20 for the additional cylinder 19 to attach to. The cradle 20 for the additional air/gas sources are also detachable. In such embodiments, an air tube runs from the cradle 20 to the fill manifold 12 of the pressure regulation device 2.

In an alternate embodiment of the present invention, the barrel 16 may comprise a breech/sleeve combination which enables a solid fixed barrel to be replaced with a breech loading configuration or vice versa. The barrel 16 may further comprise a trap door, a removable breech, a sliding door, or a combination thereof.

In a further alternate embodiment of the present invention, the pressure regulation device may not comprise the user control device 11.

Thus, with the help of the unique design and arrangement of components of the present invention, specifically the interchangeable barrel 16, interchangeable cylinder 15, and the pressure regulation device 2, the multi-projectile pneumatic launcher may launch a large multitude of items, including, but not limited to, T-shirts, confetti, streamers, rally towels, food, hot dogs, corn starch for color runs, nerf or other foam rockets, paintball, airsoft, toys, game rockets, game grenades, baseballs, golf balls, softball, tennis balls, racquet balls, dog training dummies, dog bumpers, antenna aerials, arborist throw lines, rescue lines, and/or anything under 2 pounds, that can be launched from a hand held launcher.

A preferred method of operation of the multipurpose pneumatic launcher comprises; loading a projectile into the barrel 16, pressurizing the cylinder 15, regulating the pressure with the help of the pressure regulation device 2, and triggering the valve 7 to release the energy of the compressed air/gasses into the barrel 16, thereby creating a successful launch.

Although the invention has been explained in relation to its preferred embodiment, it is to be understood that many other possible modifications and variations can be made without departing from the spirit and scope of the invention as hereinafter claimed.

What is claimed is:

1. A pneumatic launcher comprising:

a pressure transfer system;

a pressure regulation device;

a first coupler;

a second coupler;

the pressure transfer system comprising a body, a transfer channel, and a valve;

the transfer channel traversing through the body;

the valve being integrated into the transfer channel;

the pressure regulation device being connected to a first end of the transfer channel;

the first coupler being connected to the pressure regulation device opposite to the first end of the transfer channel;

the second coupler being connected to a second end of the transfer channel, opposite to the pressure regulation device;

the first coupler being in fluid communication with the second coupler through the pressure regulation device, the transfer channel, and the valve;

the pressure regulation device comprising a gauge, a user control device and a fill manifold;

the gauge being positioned in between the fill manifold and the user control device;

the gauge being operatively coupled to the first coupler, wherein the gauge is in fluid communication with the first coupler;

the user control device being operatively coupled to the gauge and the first coupler;

the user control device being adjacently positioned to the gauge such that a user is able to observe a pressure of a fluid on the gauge while operating the user control device to regulate the pressure of the fluid within the transfer channel; and the fill manifold being operatively coupled to the first coupler, wherein the fill manifold is in one-way fluid communication with the first coupler.

2. The pneumatic launcher of claim 1, comprising:

a trigger;

the trigger being connected adjacent to the body; and the trigger being operatively coupled to the valve, wherein actuating the trigger governs the operation of the valve.

3. The pneumatic launcher of claim 2, wherein the trigger being integrated into a pistol grip.

4. The pneumatic launcher of claim 1, comprising:

a cylinder;

a cylinder coupler;

the cylinder coupler being terminally connected to the cylinder; and the cylinder coupler engaging into the first coupler.

5. The pneumatic launcher of claim 1, comprising:
a barrel;
a barrel coupler;
the barrel coupler being terminally connected to the barrel; and
the barrel coupler engaging into the second coupler.

6. The pneumatic launcher of claim 1, comprising:
a first lock; and
the first lock being integrated into the first coupler.

7. The pneumatic launcher of claim 1, comprising:
a second lock; and
the second lock being integrated into the second coupler.

8. A pneumatic launcher comprising:
a pressure transfer system;
a pressure regulation device;
a first coupler;
a second coupler;
a cylinder;
a cylinder coupler;
a barrel;
a barrel coupler;
a trigger;
the pressure transfer system comprising a body, a transfer channel, and a valve;
the pressure regulation device being connected to a first end of the transfer channel;
the first coupler being connected to the pressure regulation device opposite to the first end of the transfer channel;
the second coupler being connected to a second end of the transfer channel, opposite to the pressure regulation device;
the first coupler being in fluid communication with the second coupler through the pressure regulation device, the transfer channel, and the valve;
the pressure regulation device comprising a gauge, a user control device and a fill manifold;
the gauge being positioned in between the fill manifold and the user control device;
the gauge being operatively coupled to the first coupler, wherein the gauge is in fluid communication with the first coupler;
the user control device being operatively coupled to the gauge and the first coupler;
the user control device being adjacently positioned to the gauge such that a user is able to observe a pressure of a fluid on the gauge while operating the user control device to regulate the pressure of the fluid within the transfer channel;
the fill manifold being operatively coupled to the first coupler, wherein the fill manifold is in one-way fluid communication with the first coupler;
the cylinder coupler being terminally connected to the cylinder;
the cylinder coupler engaging into the first coupler;
the barrel coupler being terminally connected to the barrel;
the barrel coupler engaging into the second coupler;
the trigger being connected adjacent to the body; and
the trigger being operatively coupled to the valve, wherein actuating the trigger governs the operation of the valve.

9. The pneumatic launcher of claim 8, comprising:
the transfer channel traversing through the body; and
the valve being integrated into the transfer channel.

10. The pneumatic launcher of claim 8, comprising:
a first lock;
a second lock;
the first lock being integrated into the first coupler; and
the second lock being integrated into the second coupler.

11. The pneumatic launcher of claim 8, wherein the trigger being integrated into a pistol grip.

12. The pneumatic launcher of claim 8, wherein the body comprises, a non-pliable material.

13. The pneumatic launcher of claim 8, wherein the valve comprises a diaphragm valve.

14. The pneumatic launcher of claim 8, wherein a diameter of the barrel ranges between approximately 1" and 4".

* * * * *